US010905251B2

(12) United States Patent
Herron

(10) Patent No.: US 10,905,251 B2
(45) Date of Patent: Feb. 2, 2021

(54) BABY SEAT AND CARRIER SYSTEM

(71) Applicant: Natasha Herron, Atlanta, GA (US)

(72) Inventor: Natasha Herron, Atlanta, GA (US)

( * ) Notice: Subject to any disclaimer, the term of this patent is extended or adjusted under 35 U.S.C. 154(b) by 151 days.

(21) Appl. No.: 16/186,147

(22) Filed: Nov. 9, 2018

(65) Prior Publication Data

US 2019/0133338 A1 May 9, 2019

Related U.S. Application Data

(60) Provisional application No. 62/583,996, filed on Nov. 9, 2017.

(51) Int. Cl.

| | |
|---|---|
| ***A47D 13/02*** | (2006.01) |
| ***A47D 1/08*** | (2006.01) |
| ***A47D 1/00*** | (2006.01) |
| ***A47D 15/00*** | (2006.01) |
| ***A47D 1/10*** | (2006.01) |
| ***A47D 9/04*** | (2006.01) |

(52) U.S. Cl.

CPC ..... *A47D 13/025* (2013.01); *A47D 1/006* (2013.01); *A47D 1/08* (2013.01); *A47D 1/10* (2013.01); *A47D 9/04* (2013.01); *A47D 15/006* (2013.01); *G10K 2210/10* (2013.01)

(58) Field of Classification Search

CPC ..... B62B 9/142; A47D 13/02
USPC ..... 297/184.13, 184.14, 184.15, 256.15
See application file for complete search history.

(56) References Cited

U.S. PATENT DOCUMENTS

| | | | | |
|---|---|---|---|---|
| 5,464,381 | A * | 11/1995 | Wilson | A47D 9/02 601/49 |
| 7,150,499 | B2 * | 12/2006 | McGregor | B60N 2/2842 297/184.13 |
| 2005/0005362 | A1 * | 1/2005 | Verbovszky | A47D 13/02 5/655 |
| 2006/0170262 | A1 * | 8/2006 | Gold | B60N 2/2869 297/256.12 |
| 2006/0261105 | A1 * | 11/2006 | Balensiefer | B60N 2/2881 224/159 |
| 2012/0062001 | A1 * | 3/2012 | Krasley | B60N 2/2845 297/184.13 |
| 2017/0318975 | A1 * | 11/2017 | Schwab | A61M 21/02 |
| 2018/0346010 | A1 * | 12/2018 | Duboff | B62B 9/22 |

* cited by examiner

*Primary Examiner* — Sarah B McPartlin

(57) ABSTRACT

A baby seat and carrier system structured and arranged to comfort and calm an infant when a caregiver is not able to by soothing and swaddling an infant in a gentle, womb-like environment, holding the infant in a natural cradling position while a rocker stand provides a relaxing continuous motion while a removable white noise generator blocks out the tumult of the outside world.

16 Claims, 7 Drawing Sheets

BABY SEAT AND CARRIER SYSTEM

CROSS-REFERENCE TO RELATED APPLICATION

The present application is related to and claims priority from prior provisional application Ser. No. 62/583,996, filed Nov. 9, 2017 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of infant soothing devices and more specifically relates to a baby seat and carrier system structured and arranged to comfort and calm an infant when a caregiver is not able to by soothing and swaddling an infant in a gentle, womb-like environment, holding the infant in a natural cradling position while a rocker stand provides a relaxing continuous motion while a removable white noise generator blocks out the tumult of the outside world.

2. Description of the Related Art

Nothing is better than a mother's touch, but sometimes mom doesn't have a hand free. Snuggle Seat soothes and swaddles your little one in a gentle, womb-like environment, holding them in a natural cradling position. Swaddling is an age-old practice of wrapping infants in blankets or similar cloths so that movement of the limbs is tightly restricted. Therefore, a need exists for a portable infant soothing device when a caregiver is not available to calm an upset infant.

Various attempts have been made to solve problems found in infant soothing device art. Among these are found in: U.S. Pat. No. 6,142,963 to Biggs et al.; U.S. Pub. No. 2014/0275742 to Unger Andrew; U.S. Pat. No. 5,520,616 to Tom L. Hofmeister; U.S. Pat. No. 6,648,411 to Christine E. Julien; and U.S. Pat. No. 9,185,994 to Burns et al. This prior art is representative of infant soothing devices. None of the above inventions and patents, taken either singly or in combination, is seen to describe the invention as claimed.

Ideally, a baby seat and carrier system should be user-friendly and safe in-use and yet would operate reliably and be manufactured at a modest expense. Thus, a need exists for a baby seat and carrier system structured and arranged to comfort and calm an infant when a caregiver is not able to by soothing and swaddling an infant in a gentle, womb-like environment, holding the infant in a natural cradling position while a rocker stand provides a relaxing continuous motion while a removable white noise generator blocks out the tumult of the outside world and to avoid the above-mentioned problems.

BRIEF SUMMARY OF THE INVENTION

In view of the foregoing disadvantages inherent in the known of infant soothing device art, the present invention provides a novel Baby Seat and Carrier System. The general purpose of the present invention, which will be described subsequently in greater detail is to provide a baby seat and carrier system structured and arranged to comfort and calm an infant when a caregiver is not able to by soothing and swaddling an infant in a gentle, womb-like environment, holding the infant in a natural cradling position while a rocker stand provides a relaxing continuous motion while a removable white noise generator blocks out the tumult of the outside world.

A baby seat and carrier system comprises: a main body; a seat; a harness; a cover; a screen; and a noise generator. Wherein the main body forms a curved protective shell having an interior surface and a front opened portion. Wherein the seat is removably attached to the interior surface and is adapted to removably hold a baby therein. Wherein the harness is attached to the main body and adapted to removably hold the baby upon the seat and within the curved protective shell. Wherein the cover is pivotally attached to the main body and adapted to removably cover a portion of the front opened portion. Wherein the screen is attached to the main body and adapted to removably cover a portion of the front opened portion. Wherein the cover and the screen portion together removably cover the entire front opened portion. Wherein the noise generator is attached to the main body and adapted to produce noise adapted to block out noise from outside the baby seat and carrier system and soothe the baby.

The present invention holds significant improvements and serves as a Baby Seat and Carrier System. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, a Baby Seat and Carrier System, constructed and operative according to the teachings of the present invention.

The various embodiments of the present invention will hereinafter be described in conjunction with the appended drawings, wherein like designations denote like elements.

DETAILED DESCRIPTION

Figure 1:
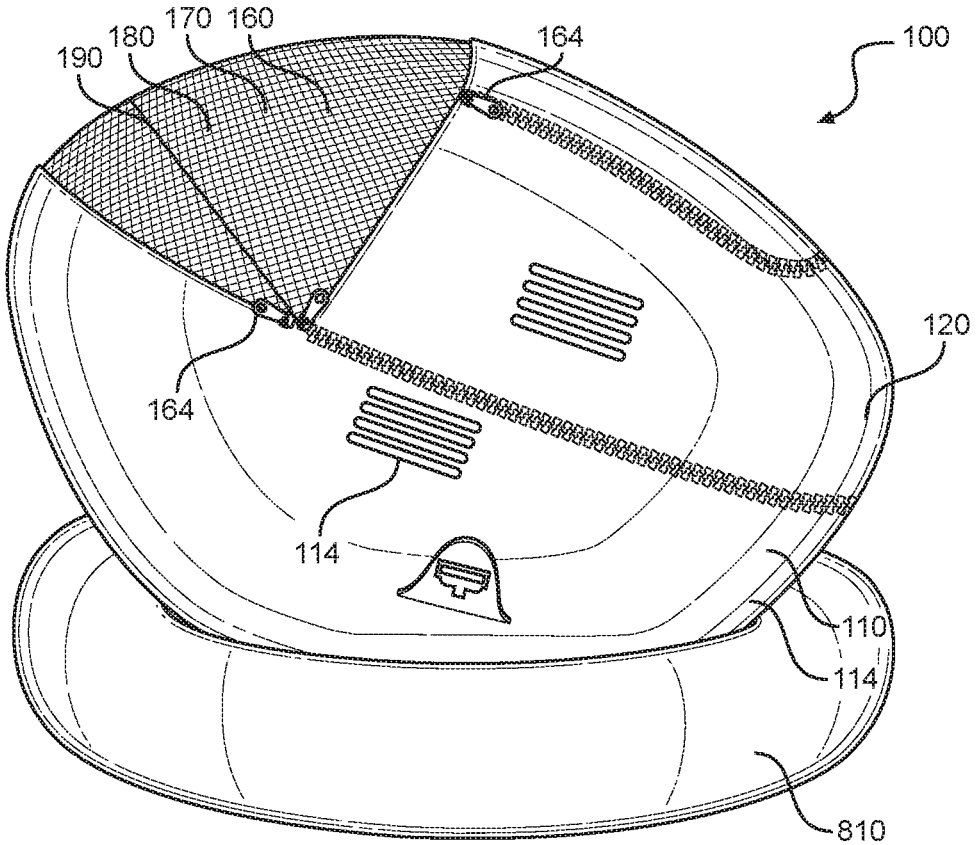
FIG. 1 shows an exterior side perspective view illustrating a baby seat and carrier system in a deployed position according to an embodiment of the present invention.

As discussed above, embodiments of the present invention relate to infant soothing device and more particularly to a baby seat and carrier system structured and arranged to comfort and calm an infant when a caregiver is not able to by soothing and swaddling an infant in a gentle, womb-like environment, holding the infant in a natural cradling position while a rocker stand provides a relaxing continuous motion while a removable white noise generator blocks out the tumult of the outside world.

Generally speaking, the baby seat and carrier system is meant to simulate a mother's womb by providing a cozy enclosed space for the baby with optional soothing sounds and vibration. This "egg" consists of a semi rigid shell with a carseat-like inner structure. This inner structure is meant to put baby into a comfortable laying position with the knees slightly bent and back slightly curved. There are straps that hold the baby down for safety. There is a zip open door which allows the baby to enter and exit more easily and when the door is closed, there is a small opening above the baby's face. There is an optional screen cover that can close off this final opening while still providing adequate ventilation. This screen cover can zip completely off of the structure, or it can zip onto the structure in either a closed position or an open position. This allows for maximum flexibility.

There are extra vents in the egg structure for safety and ventilation. There are also two buckles which will serve as tie down points for future appliances that this egg structure will fit into, such as a rocker or floor stand. The egg will "snap" into each of these accessory appliances. There is a flat section on the bottom of the egg to increase the stability when sitting on the ground or when used with an accessory appliance. And finally, there is a sound box that mounts to the door of the egg. It is a simple device that has 10-15 recorded sounds within. By hitting the "mode" button, the user can change the sound. There will be a variety of sounds including but not limited to white noise, ocean waves, heartbeat, sounds that simulate the inside of a womb, nursery rhymes, rain . . . etc. There will be a + and – volume button as well as a "vibrate" button. There will be two vibratory motors mounted inside the plastic "carseat" base structure underneath the babies' bottom. When the "vibrate" button is pushed it will turn these motors on and provide a small, soothing vibration to the base. The screen of the sound box will display what sound is playing, the volume level, and whether the vibrate function is on or off. The screen will not be a touchscreen, but instead just a digital readout that can be changed using the buttons. The screen is facing the adult, while the speaker on the back of the sound box faces the inside of the egg. This will isolate the noise to within the egg for better soothing. The wiring for the vibration motors will route inside the molded foam and plastic components and will not be visible or accessible to the user. The sound box will also store batteries that will operate the vibratory motors and the sound box.

The main base structure of the egg will be a molded feature consisting of a layer of plastic to create the desired rigidity, 2 layers of foam to create the desired ambiance and soft interior/exterior, and 2 layers of upholstery (1 on the inside and 1 on the outside) to give it a finished look. These types of molds are created by layering the fabric/foam/plastic with adhesives in-between and vacuum forming it into the desired shape.

The plastic car seat base structure is also a molded structure consisting of a layer of plastic at its core, then a layer of medium density foam on top, and finally a layer of waterproof fabric to easily wipe up spills. There will be removable, machine washable covers for the seat that will be simply upholstered fabric sewn together, with a thin low-density foam sewn to the inside for additional padding.

The plastic seat structure is permanently attached to the inside of the egg base with a combination of plastic snap features that were molded previously into each component and adhesive. The belt straps are permanently fixed to the plastic seat structure in a way that will conform to safety requirements.

The door is a molded feature as well but is simply high-density foam in the middle and upholstery on either side which will match the interior and exterior of the egg base.

The screen is a fabric mesh screen with a layer of molded foam around the perimeter that is stitched together around the perimeter. The mesh screen is thin and flimsy material, so the foam perimeter gives it a more rigid structure to hold the device's shape.

The buckles on the outside of the egg base are standard off-the-shelf metal buckles and will be riveted onto the egg structure with steel rivets.

Referring to the drawings by numerals of reference there is shown in FIGS. 1-9, perspective views illustrating baby seat and carrier system 100 according to an embodiment of the present invention.

Figure 2:
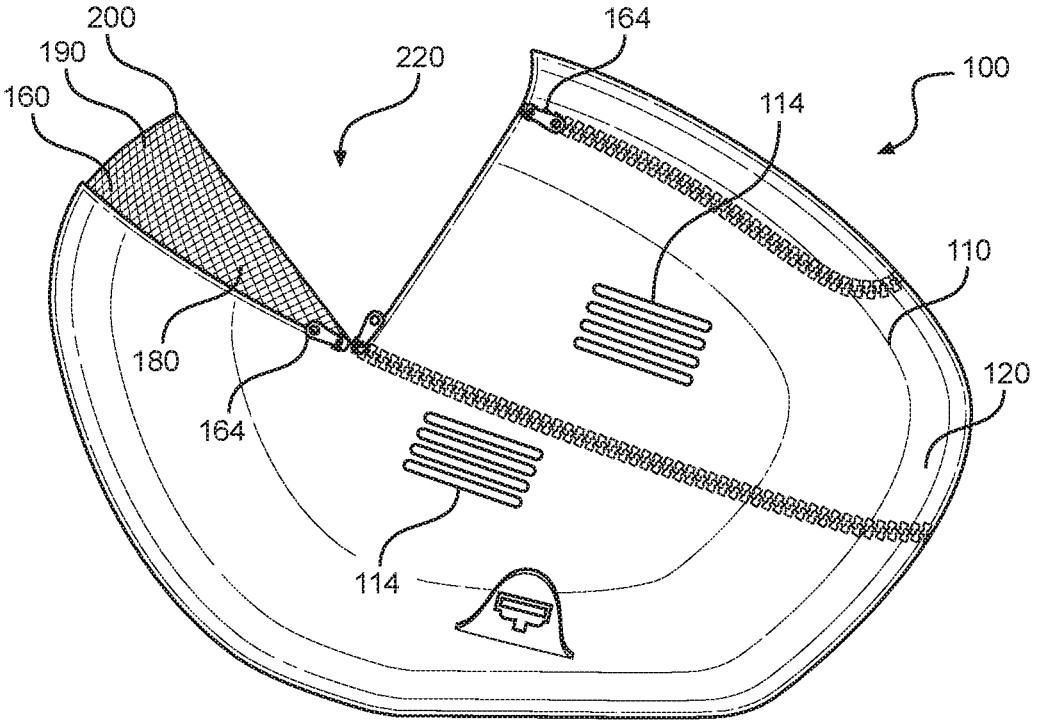
FIG. 2 shows an exterior side perspective view illustrating the baby seat and carrier system in a folded position according to an embodiment of the present invention.
Figure 3:
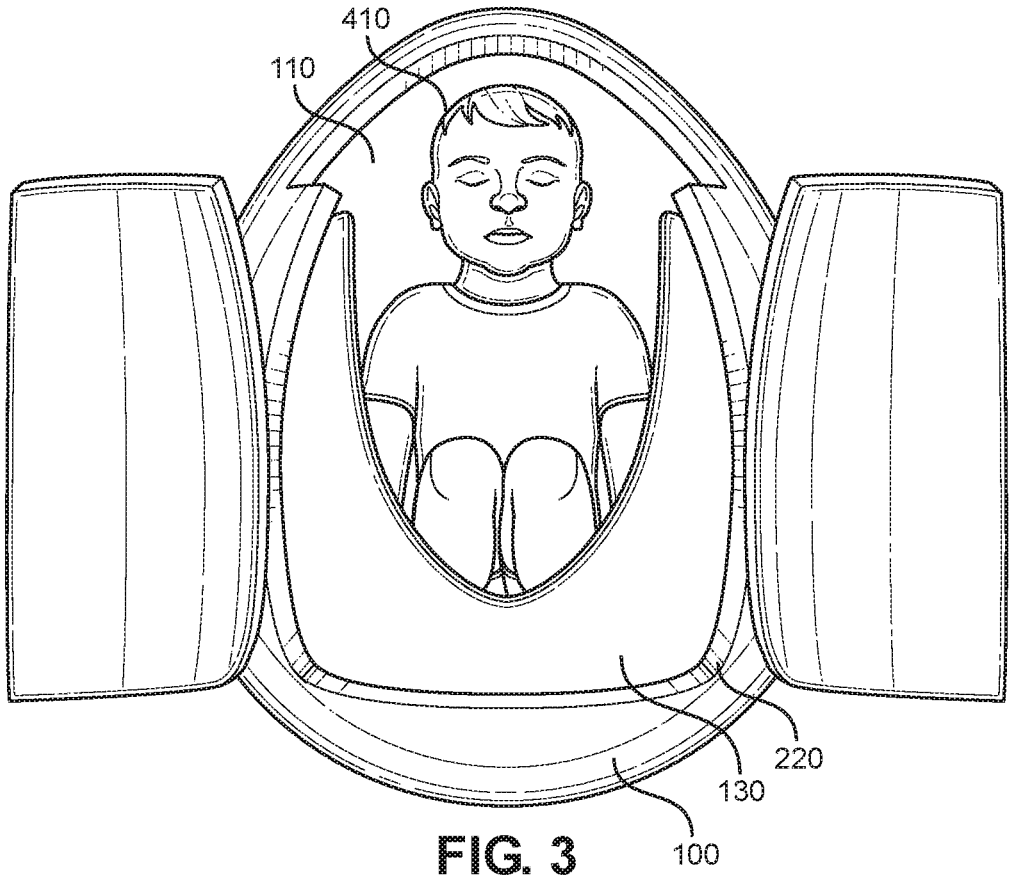
FIG. 3 is a perspective view illustrating the baby seat and carrier system in an in-use condition according to an embodiment of the present invention of FIG. 1.
Figure 4:
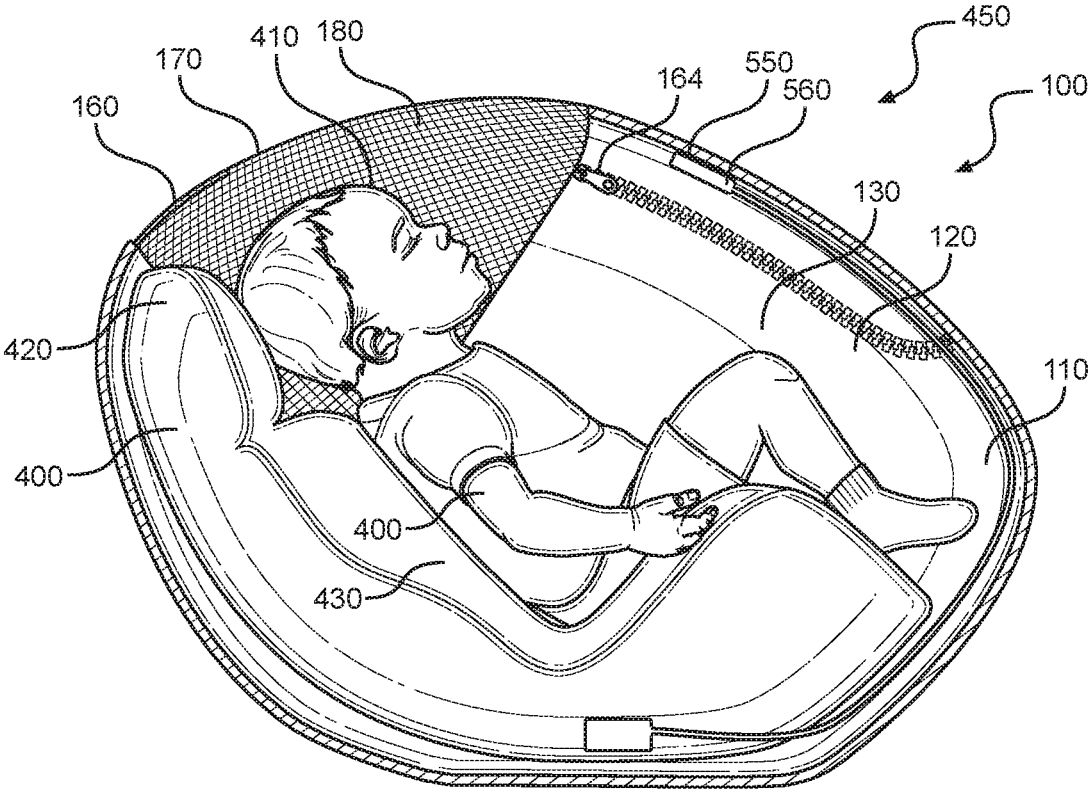
FIG. 4 is a side interior perspective view illustrating electronics of the baby seat and carrier system according to an embodiment of the present invention of FIG. 1.
Figure 5:
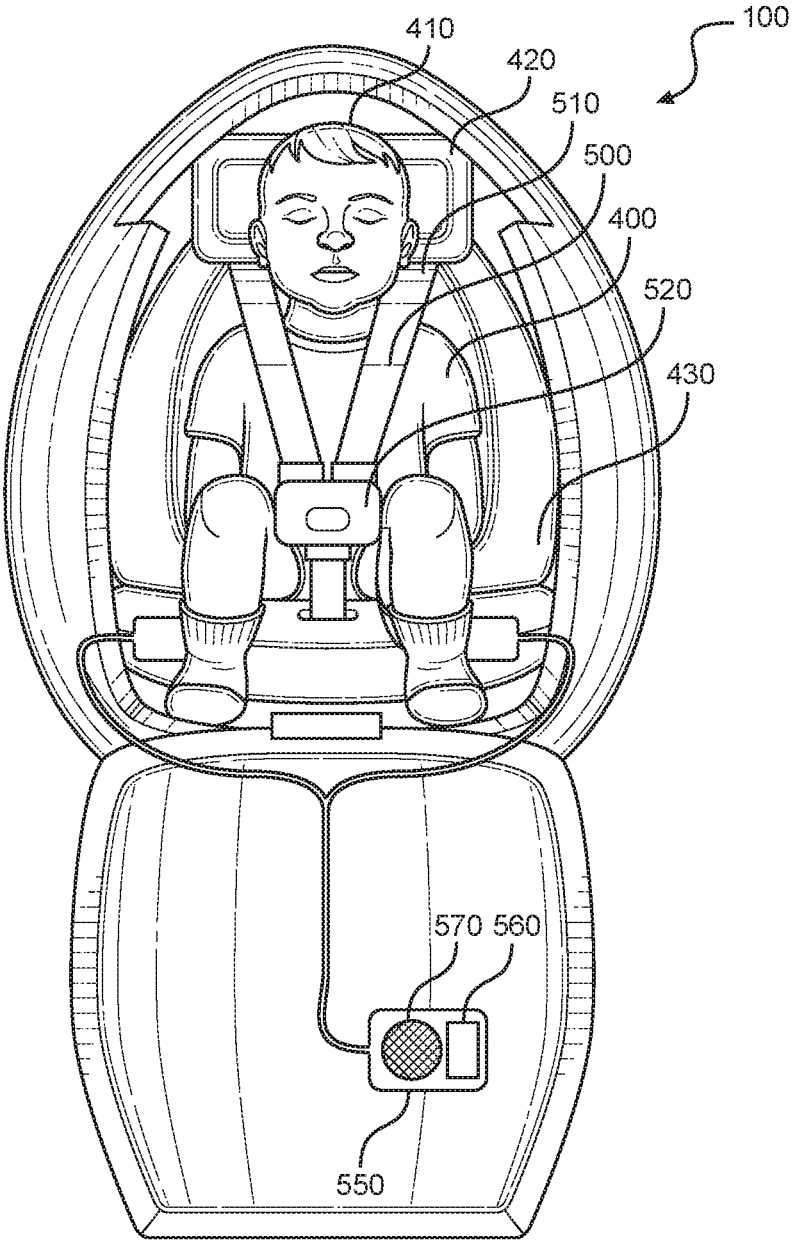
FIG. 5 is a perspective view illustrating a harness and noise generator of the baby seat and carrier system according to an embodiment of the present invention of FIG. 1.
Figure 6:
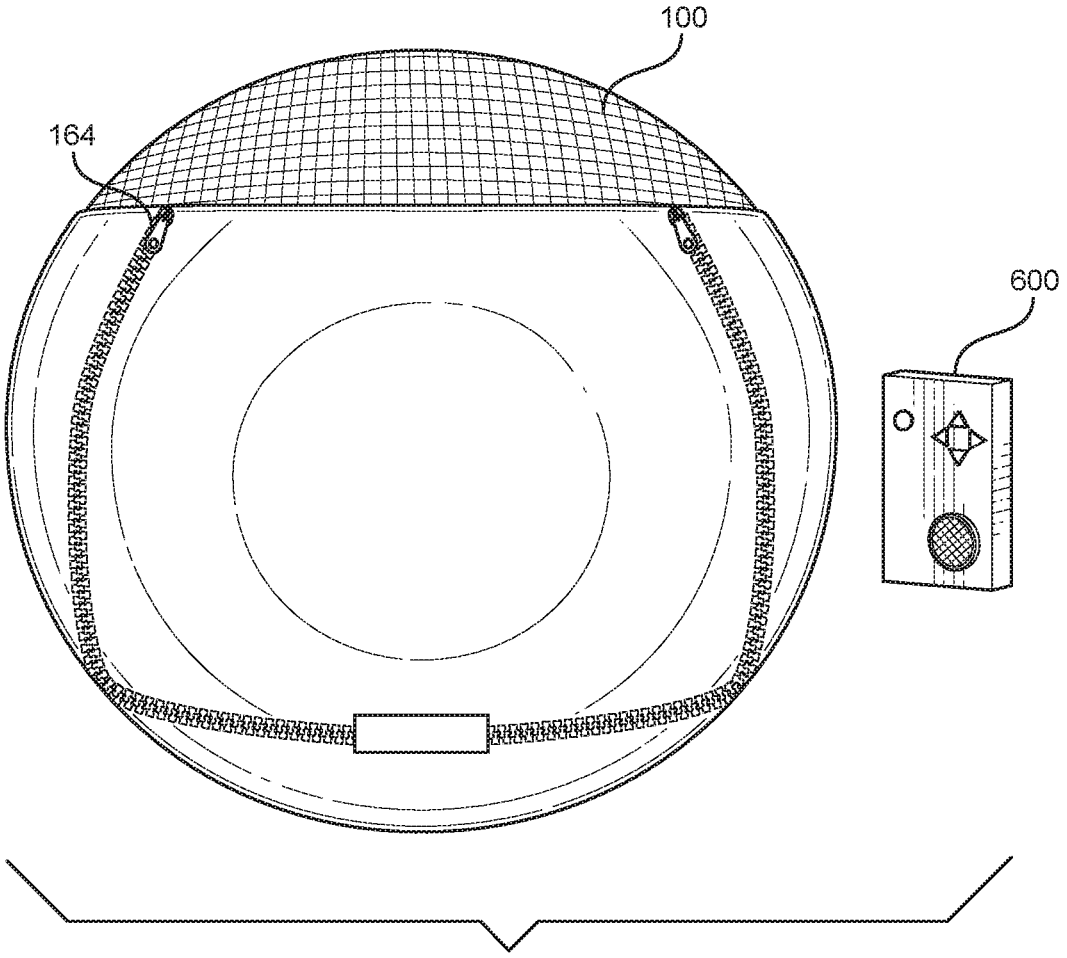
FIG. 6 is a top perspective view of the baby seat and carrier system according to an embodiment of the present invention of FIG. 1.
Figure 7:
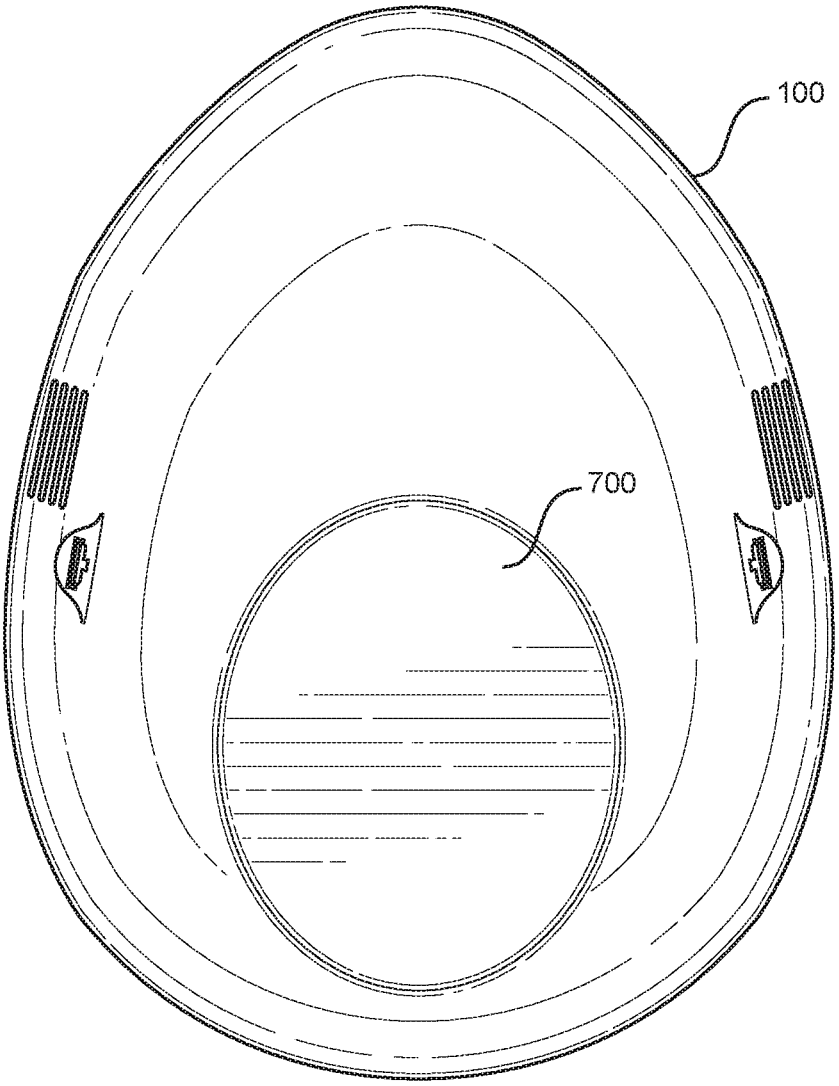
FIG. 7 is a bottom perspective view of the baby seat and carrier system according to an embodiment of the present invention of FIG. 1.

Baby seat and carrier system 100 comprises: main body 110; seat 400; harness 500; cover 160; screen 180; and noise generator 550. Wherein main body 110 forms curved protective shell 120 having interior surface 130 and front opened portion 220. Wherein main body 110 includes at least one vent 114 therethrough adapted to allow air to pass therethrough. Wherein main body 110 is formed from hardened plastic. Wherein baby seat and carrier system 100 is formed having an egg-shape with flat bottom 700 as shown in FIG. 7.

Wherein seat 400 is removably attached to the interior surface and is adapted to removably hold baby 410 therein as shown in in-use condition 450 of FIG. 4. Baby seat and carrier system 100 further comprising head rest 420 removably attached to seat 400 and adapted to hold and cushion the head of baby 410. Wherein said seat 400 includes padding 430 adapted to comfort baby 410.

Wherein harness 500 is attached to main body 110 and adapted to removably hold baby 410 upon seat 400 and within curved protective shell 120. Wherein harness 500 includes plurality of straps 510 and at least one buckle member 520 adapted to releasably connect straps 510 to main body 110.

Wherein cover 160 is pivotally attached to main body 110 and adapted to removably cover a portion of front opened portion 220. Wherein screen 180 is attached to main body 110 and adapted to removably cover a portion of front opened portion 220. Wherein cover 160 and screen portion 180 together removably cover the entire front opened portion 220. Wherein screen 180 is formed from a material adapted to block ultra violet rays from the sun. Wherein screen 180 includes frame 190 pivotally attached to main body 110 and adapted to pivotally move screen 180 between folded position 200 as shown in FIG. 2 and deployed position 170 as shown in FIG. 1 to thereby removably cover a portion of front opened portion 220. Wherein cover 160 is formed from a flexible fabric and is releasably connected to main body 110 via removable fastener 164. Wherein removable fastener 164 is formed as a zipper.

Wherein noise generator 550 is attached to main body 110 and adapted to produce noise adapted to block out noise from outside baby seat and carrier system 100 and soothe baby 410. Wherein noise generator 550 includes at least one speaker 560 attached to main body 110; and control panel 600 attached to an outer surface of main body 110 as shown in FIG. 6. Wherein noise generator 550 includes computer 570 adapted to store and play music.

Figure 8:
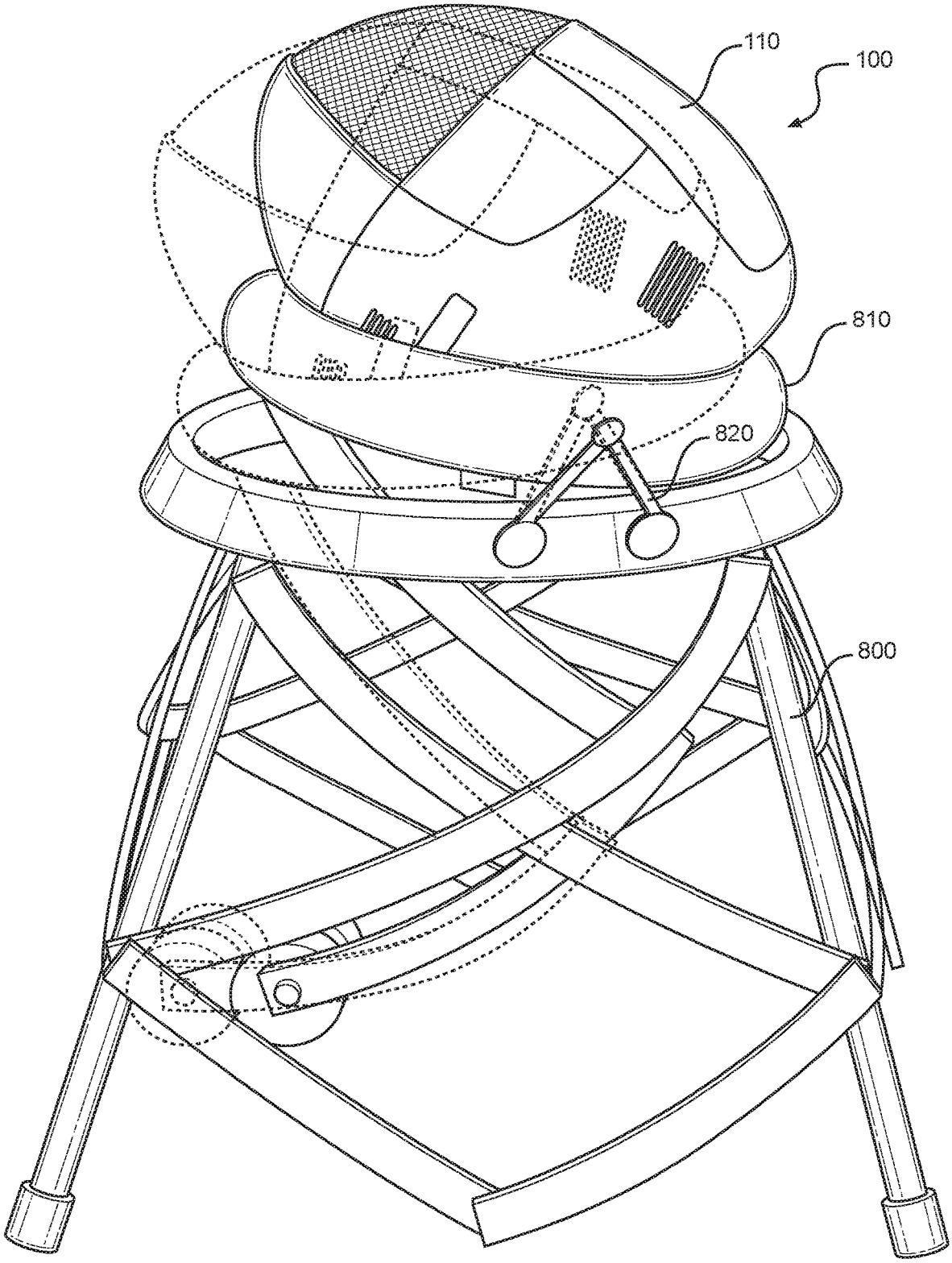
FIG. 8 is a perspective view illustrating a rocker stand of the baby seat and carrier system according to an embodiment of the present invention of FIG. 1.

Baby seat and carrier system 100 further comprising rocker stand 800 adapted to movably hold main body 110 thereon, adapted to support main body 110 upon support surface 810, and adapted to rock main body 110 with respect to support surface 810 as shown in FIG. 8. Wherein rocker stand 800 is formed from a flexible material that is inflatable. Wherein main body 110 includes at least one strap connector 820 formed on an exterior surface thereof adapted to allow baby seat and carrier system 100 to be releasably attached to support surface 810 as shown in FIG. 8.

Figure 9:
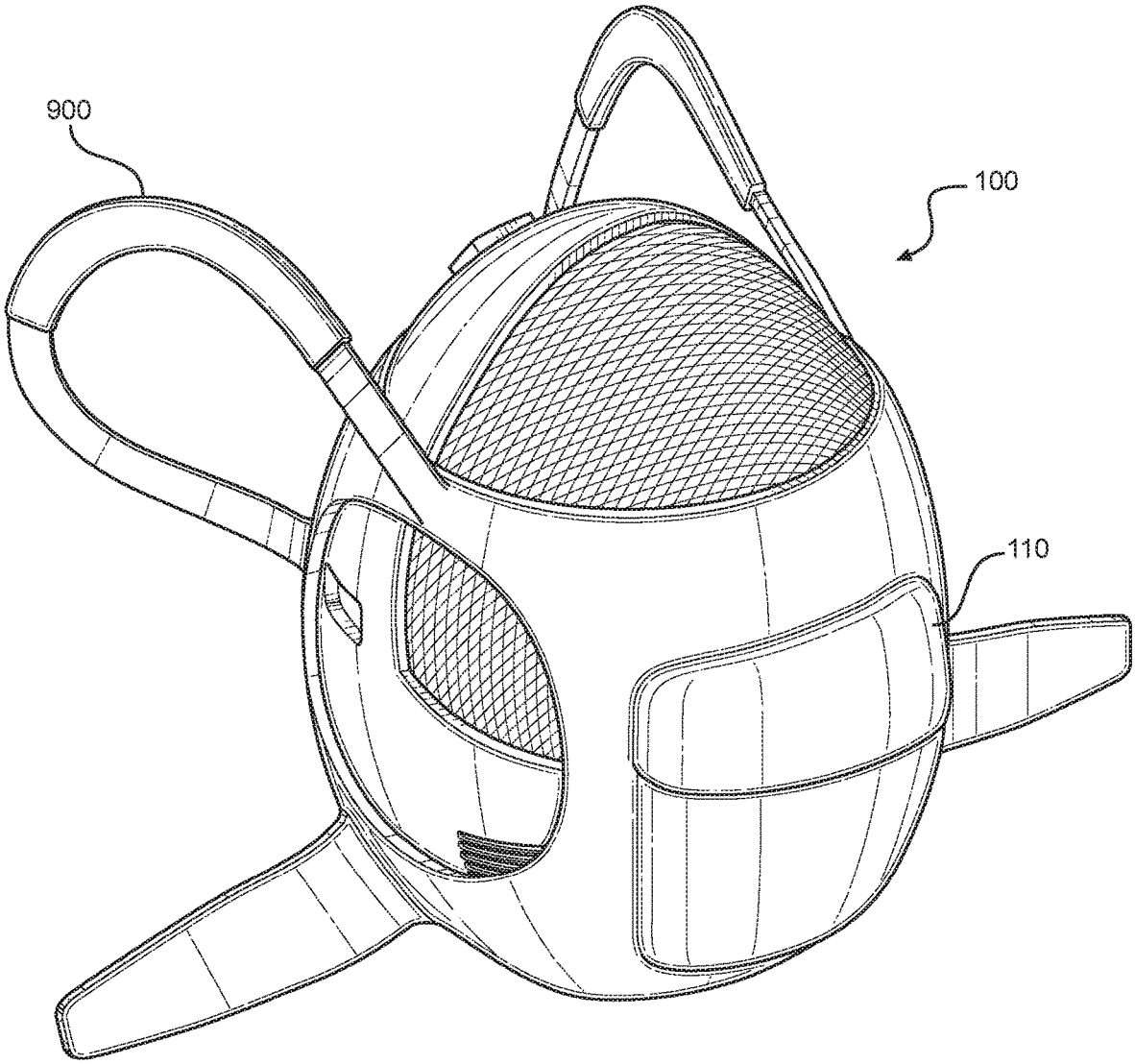
FIG. 9 is a perspective view illustrating baby seat and carrier system comprising at least one handle attached to an exterior surface of a main body according to an embodiment of the present invention of FIG. 1.

Baby seat and carrier system 100 may comprise at least one handle 900 attached to an exterior surface of main body 110 as shown in FIG. 9.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is:

1. A baby seat and carrier system comprising:

a main body;

the main body forming a curved protective shell;

the main body comprising two opposite lateral sides, an exterior surface, an interior surface and a front opened portion;

a seat;

the seat being removably attached to the interior surface and being adapted to removably hold a baby therein;

a harness;

the harness being attached to the main body and being adapted to removably hold said baby upon the seat and within the curved protective shell;

a cover;

the cover being pivotally attached to the main body and being adapted to removably cover a portion of the front opened portion;

a screen;

the screen being attached to the main body and being adapted to removably cover a remaining portion of the front opened portion; and the cover and the screen portion together removably covering an entire portion of the front opened portion;

a noise generator;

the noise generator being attached to the main body and being adapted to produce noise adapted to block out noise from outside the baby seat and carrier system and soothe said baby;

the main body comprising at least one vent; and the at least one vent being formed on the two opposite lateral sides and penetrating the exterior surface and the interior surface so as to allow air to laterally pass through the main body.

2. The baby seat and carrier system of claim 1, further comprising a rocker stand adapted to movably hold the main body thereon, adapted to support the main body upon a support surface, and adapted to rock the main body with respect to said support surface.

3. The baby seat and carrier system of claim 1, further comprising at least one handle attached to the exterior surface.

4. The baby seat and carrier system of claim 2, wherein the rocker stand is formed from a flexible material that is inflatable.

5. The baby seat and carrier system of claim 1, wherein the screen is formed from a material adapted to block ultraviolet rays.

6. The baby seat and carrier system of claim 1, wherein the screen includes a frame pivotally attached to the main body and adapted to pivotally move the screen between a folded position and a deployed position to thereby removably cover the remaining portion of the front opened portion.

7. The baby seat and carrier system of claim 1, wherein the main body is formed from hardened plastic.

8. The baby seat and carrier system of claim 1, wherein the harness includes a plurality of straps and at least one buckle member adapted to releasably connect the plurality of straps to the main body.

9. The baby seat and carrier system of claim 1, further comprising a head rest removably attached to the seat and adapted to hold and cushion a head of said baby.

10. The baby seat and carrier system of claim 1, wherein the cover is formed from a flexible fabric and is releasably connected to the main body via a removable fastener.

11. The baby seat and carrier system of claim 10, wherein the removable fastener is a zipper.

12. The baby seat and carrier system of claim 1, wherein the noise generator includes at least one speaker attached to the main body and a control panel attached to the exterior surface.

13. The baby seat and carrier system of claim 1, wherein the noise generator includes a computer adapted to store and play music.

14. The baby seat and carrier system of claim 1, wherein the main body has an egg-shape.

15. The baby seat and carrier system of claim 1, wherein the main body includes at least one strap connector formed on the exterior surface adapted to allow the baby seat and carrier system to be releasably attached to a support surface.

16. The baby seat and carrier system of claim 1, wherein the seat includes padding adapted to comfort said baby.

* * * * *